US007750771B2

(12) United States Patent
Yamada et al.

(10) Patent No.: US 7,750,771 B2
(45) Date of Patent: Jul. 6, 2010

(54) SWITCHING DEVICE

(75) Inventors: Tomio Yamada, Aichi (JP); Katsuhide Kumagai, Aichi (JP); Masahiko Miyata, Aichi (JP); Yoshinori Ota, Miyagi (JP); Tatsumi Ide, Miyagi (JP)

(73) Assignees: Kabushiki Kaisha Tokai Rika Denki Seisakusho, Aichi (JP); NEC Tokin Corporation, Sendai Miyagi (JP)

( * ) Notice: Subject to any disclaimer, the term of this patent is extended or adjusted under 35 U.S.C. 154(b) by 60 days.

(21) Appl. No.: 12/081,867

(22) Filed: Apr. 22, 2008

(65) Prior Publication Data

US 2009/0072936 A1 Mar. 19, 2009

(30) Foreign Application Priority Data

Apr. 23, 2007 (JP) ..... 2007-113002
Oct. 3, 2007 (JP) ..... 2007-259987

(51) Int. Cl.
*H01H 9/00* (2006.01)

(52) U.S. Cl. ..... 335/205; 335/177

(58) Field of Classification Search ..... 335/205, 335/207, 177, 179
See application file for complete search history.

(56) References Cited

U.S. PATENT DOCUMENTS 2,240,847 A * 5/1941 Hildebrecht ..... 335/205
2,521,723 A * 9/1950 Hubbell ..... 335/207
3,024,411 A * 3/1962 Hours ..... 335/207
3,264,424 A * 8/1966 Baermann ..... 335/207
3,284,743 A * 11/1966 Spewock et al. ..... 335/205
3,539,741 A * 11/1970 Voland ..... 200/61.62
3,539,957 A * 11/1970 Matto et al. ..... 335/205
4,150,350 A * 4/1979 Fong ..... 335/205
4,349,800 A * 9/1982 Shimoya ..... 335/207
4,596,971 A * 6/1986 Hirabayashi et al. ..... 335/205
4,751,485 A * 6/1988 Fujio et al. ..... 335/206
6,972,651 B2 * 12/2005 Aoki et al. ..... 335/207
7,167,675 B2 * 1/2007 Lynch et al. ..... 434/317
2006/0082429 A1 * 4/2006 Lynch et al. ..... 335/205

FOREIGN PATENT DOCUMENTS

JP 2005-235632 9/2005

* cited by examiner

*Primary Examiner*—Lincoln Donovan
*Assistant Examiner*—Alexander Talpalatskiy

(57) ABSTRACT

Magnetic attractive force of a magnet exerted on a movable contact in a sealing case through yokes changes as a result of movement of a magnetic shunt element induced by movement of a movable element located outside the sealing case. As a result, the movable contact can be brought into or out of contact with a stationary contact without involvement of entry of the movable element into the sealing case.

6 Claims, 5 Drawing Sheets

SWITCHING DEVICE

BACKGROUND OF THE INVENTION

The present invention relates to a switching device having an improved operation structure of a contact.

In general, there has hitherto been provided a switching device with a case housing a stationary contact, a movable contact, and a spring for bringing the movable contact into or out of contact with the stationary contact, wherein a rod-shaped movable element is provided so as to penetrate through the case and wherein, as a result of the movable element being movably operated, the movable contact is moved relatively to the stationary contact, to thus come into or out of contact with the stationary contact (see JP-A-2005-235632).

The switching device of the above configuration is used; for example, as a stop lamp switch for a vehicle (a vehicle stop lamp switch), and lubricating oil applied to various mechanical sections and inorganic and organic substances included in products are present around the vehicle stop lamp switch. In contrast, in the related-art switching device, the lubricating oil and extraneous matters, such as inorganic and organic substances, intrude into the case from an area where the movable element is inserted. The thus-intruded lubricating oil or the extraneous matters adhere to a space between the movable contact and the stationary contact, which may especially raise a problem of an electrical conduction failure between the contacts being induced by a silicone component.

SUMMARY OF THE INVENTION

The present invention has been conceived in light of the foregoing situation and aims at providing a switching device that prevents intrusion of extraneous matters, such as lubricating oil, into a case housing a stationary contact and a movable contact, thereby enabling the movable contact to come into or out of contact with the stationary contact; and that also enables the movable contact to come into or out of contact with the stationary contact at higher speed, thereby enhancing switching performance.

In order to achieve the object, a switching device of the present invention is characterized by comprising a stationary contact; a movable contact that is in correspondence with the stationary contact and that exhibits magnetism; a sealing case that houses and seals the stationary contact and the movable contact; yokes that are in correspondence with the movable contact and that exhibit magnetism; a magnet that exerts magnetic force to the yokes, to thus attract the movable contact through the yokes; a movable element that is situated outside the sealing case and that is movably operated; and a magnetic shunt element that is moved by the movable element, wherein the magnetic shunt element is moved so as to change a distance to the yoke and change attractive force that is exerted on the movable contact by the magnet through the yokes, thereby moving the movable contact with respect to the stationary contact (claim 1).

ADVANTAGE OF THE INVENTION

According to the above means, the magnetic attractive force of the magnet exerted on the movable contact in the sealing case through the yoke is changed as a result of the magnetic shunt element being moved by movement of the movable element located outside the sealing case. As a result, the movable contact can be moved with respect to the stationary contact without entry of the movable element into the sealing case. Therefore, the movable contact and the stationary contact, which are housed in the sealing case, can be brought into or out of contact with each other without involvement of intrusion of, into the sealing case, lubricant oil or inorganic/organic extraneous matters which are located around the sealing case. As a result, the risk of a problem of an electrical conduction failure between contacts, which would otherwise be caused conventionally by intrusive substances, can be obviated.

A change in the magnetic attractive force of a magnet exerted on the movable contact in the sealing case through the yoke, the change being induced by movement of the magnetic shunt element, can be made more rapid than that achieved when the magnet itself is moved. As a result, the movable contact can be brought into or out of contact with the stationary contact more rapidly, so that switching performance can be enhanced.

DETAILED DESCRIPTION OF PREFERRED EMBODIMENTS

First Embodiment

The present invention is applied to a stop lamp switch for a vehicle, and its first embodiment (a first mode of practice of the invention) will be described hereunder by reference to FIGS. 1 through 3.

Figure 1:
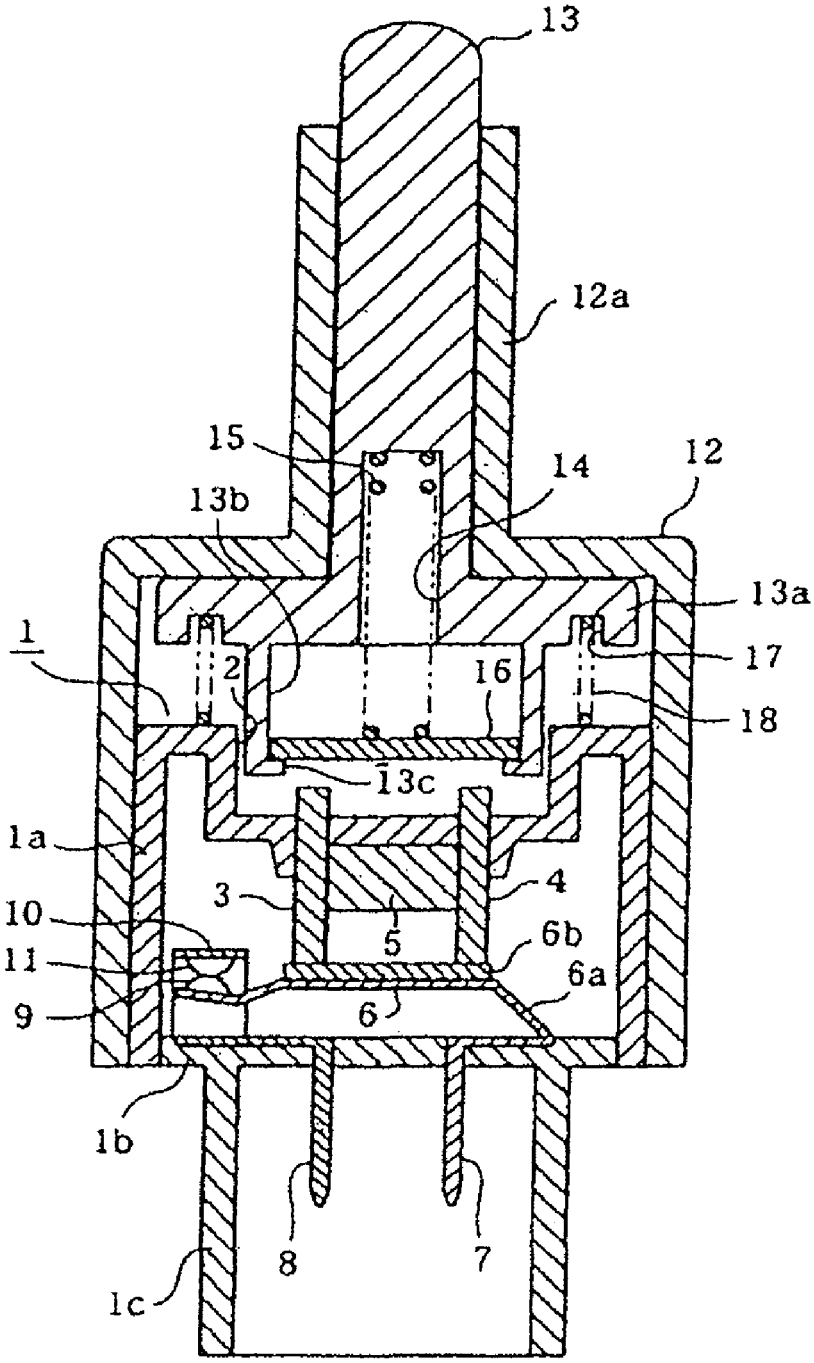
FIG. 1 is a longitudinal cross-sectional view of an overall switching device representing a first embodiment of the present invention.
Figure 2:
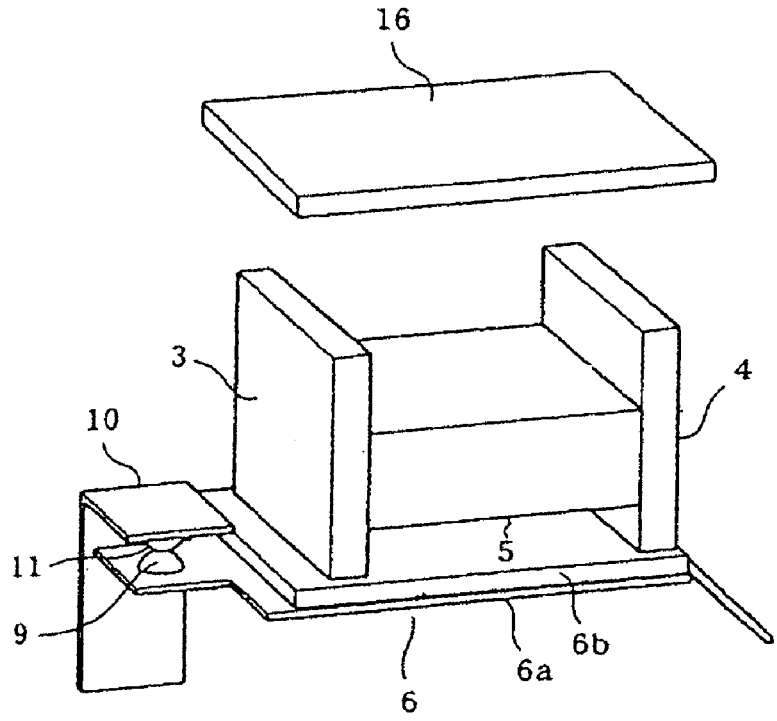
FIG. 2 is a perspective view of the principal section achieved before operation of a movable element.

First, FIG. 1 shows the configuration of an over all vehicle stop lamp switch, and the stop lamp is primarily made up of a sealing case 1. The sealing case 1 includes a case main section 1*a* and a case bottom plate 1*b*. The case main section 1*a* wholly assumes the shape of a square box, wherein an upper surface portion of the main section is closed and wherein a bottom of the main section is opened.

A recess 2 is formed in the center of the upper surface portion of the case main body section 1*a*, and yokes 3 and 4 are provided so as to penetrate into the case main body section 1*a* from the bottom of the recess 2. The yokes 3 and 4 are formed from a magnetic material, such as iron; namely, possess a magnetic property. The yokes are provided as inserts at the time of molding of the case main body section 1*a*, whereby the yokes are integrated with the case main body section 1*a*. The form of integration of the yokes with the case main body section is arranged such that intermediate portions of the yokes 3 and 4 are held in close contact with an upper wall portion of the case main section 1*a*, thereby preventing exhibition of permeability between upper and lower spaces partitioned with the upper wall section of the case main body section 1*a*. Upper portions of the yokes 3 and 4 protrude outside the case main body section 1*a* (the inside of the recess 2) that is a space higher than the upper wall portion of the case main body section 1*a*. Respective lower portions protrude into the case main body section 1*a* that is a space located lower than the upper wall portion of the case main body section 1*a*.

Alternatively, a magnet (a permanent magnet) 5 is situated between the yokes 3 and 4 within the case main body section 1*a*. This magnet 5 is provided as an insert; for example, at the time of formation of the case main body section 1*a*, and is integrated with the case main body section 1*a*. In an integrated form of the magnet and the case main body section, an upper portion of the magnet 5 is situated in the upper wall of the case main body section 1*a*, and both sides of the magnet 5 remain in contact with the yokes 3 and 4, and a lower surface of the magnet is exposed through the inside of the case main body section 1*a*.

In the drawing, the yokes 3 and 4 are arranged side by side, and a movable contact 6 is arranged at a position immediately below the yokes. In this case, the movable contact 6 includes a contact main plate 6*a* made of a conductive spring material, such as phosphor bronze serving as a nonmagnetic material, and a magnetic plate 6*b* that is fixed to an upper surface of the contact main plate and is formed from a magnetic material, such as iron. The magnetic plate 6*b* exhibits magnetic properties.

The contact main plate 6*a* is formed integrally with; for example, a connection terminal 7. The connection terminal 7 is provided so as to penetrate through a case bottom plate 1*b* in connection with a connection terminal 8. More specifically, the connection terminals 7 and 8 are also provided as inserts at the time of formation of the case bottom plate 1*b*, to thus be integrated with the case main body section 1*a*. In the integrated form of the connection terminals and the case main body section, upper portions of the respective connection terminals 7 and 8 are held in intimate contact with the case bottom plate 1*b*, thereby preventing exhibition of permeation between upper and lower spaces partitioned with the case bottom plate 1*b*. Respective lower portions of the connection terminals 7 and 8 project downwardly from the case bottom plate 1*b*.

In connection with the integration of the connection terminals 7 and 8 with the case bottom plate 1*b*, there may also be adopted a structure in which a hole is formed in the case bottom plate 1*b*; which the connection terminals 7 and 8 are inserted into the hole; and clearance between the hole and the connection terminals is sealed with a sealing compound. Further, there may also be adopted a structure that can be adopted also for an area where the yokes 3 and 4 are integrated into the case main body section 1*a*; namely, a structure where a hole is formed in the case main body section 1*a* and where the yokes 3 and 4 are inserted into the hole and where clearance between the yokes and the hole is sealed with a sealing compound.

Figure 3:
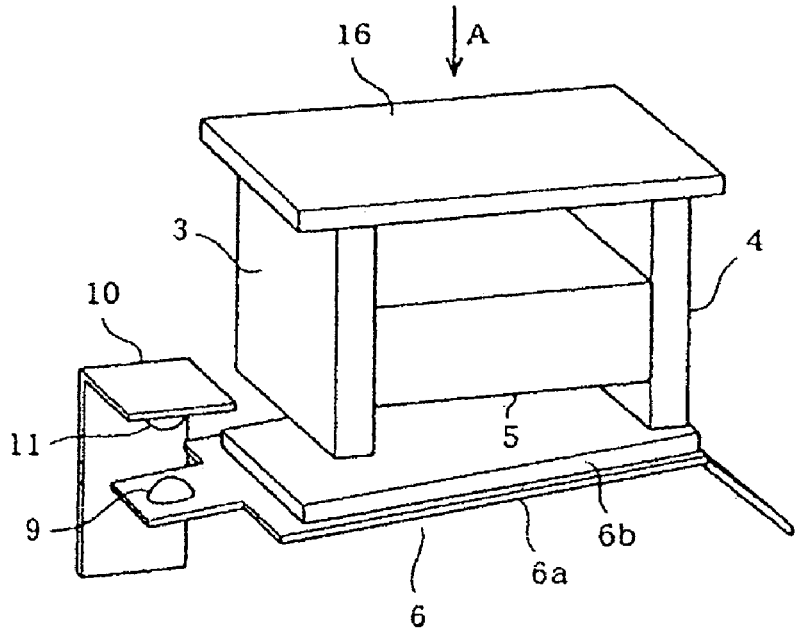
FIG. 3 is a perspective view of the principal section achieved after operation of the movable element.

The contact main plate 6*a* of the movable contact 6 extends from an upper portion of the connection terminal 7 in an upwardly left oblique direction in the drawing and further extends, in normal conditions, in a downwardly left oblique direction in FIG. 3. The case bottom plate 1*b* is joined to a bottom portion of the case main body section 1*a*, thereby hermetically closing opening of the bottom portion. In this state, in relation to the movable contact 6, a right edge of the magnetic plate 6*b* remains in contact with the lower edge of the right yoke 4 at a top of the contact main plate 6*a* extending upwardly from the upper portion of the connection terminal 7.

Accordingly, a portion of the movable contact 6 extending in a downwardly left oblique direction in FIG. 3 is originally situated at a position downwardly spaced from the left yoke 3. In a situation, shown in FIGS. 1 and 2, where magnetic force of the magnet 5 reaches to the movable contact 6 (the magnetic plate 6*b*) through the yokes 3 and 4, the movable contact is attracted by the magnet 5 through the yokes 3 and 4 and elastically deformed in an essentially-horizontal state.

A contact point 9 is provided on an upper surface of an extremity portion (the left edge) of the contact main plate 6*a*. In contrast, a contact point 11 of the stationary contact 10 is disposed opposite the contact point 9 at a position above the same. In a state where the movable contact 6 is attracted by the magnet 5 and held in an essentially-horizontally, elastically deformed state, the contact point 9 of the movable contact 6 remains in contact with the contact point 11 of the stationary contact 10, so that the stationary contact 10 is formed integrally with the connection terminal 8.

The case bottom plate 1*b* is jointed to the bottom portion of the case main body section 1*a* as mentioned previously, thereby constituting the sealing case 1 and a structure in which the stationary contact 10 and the lower portions of the movable contact 6, the magnet 5, and the yokes 3 and 4 are stored in the sealing case 1.

The connection terminals 7 and 8 projecting downwardly from the case bottom plate 1*b* are surrounded by a cylindrical portion 1*c* formed integrally with the case bottom plate 1*b*. An unillustrated conductive wire is connected through an unillustrated connector inserted into the cylindrical portion 1*c*.

A cover 12 is attached to the outside of the sealing case 1 (the case main body section 1*a*), and the cover 12 has a cylindrical section 12*a* in the center of the upper portion of the cover. A rod-shaped movable element 13 is inserted into the cylindrical section 12*a*. The movable element 13 has a brim section 13*a* provided at a lower portion of the movable element that is located lower than the cylindrical section 12*a* (i.e., a position between the cover 12 and the sealing case 1). A short cylindrical holder section 13*b* is formed downwardly from the brim section 13*a*. In addition, a hole 14 is upwardly formed in a lower end of the center that is inward of the holder section 13*b*.

A coil spring 15 serving as an elastic element is housed in the hole 14 of the movable element 13, and a magnetic shunt element 16 is housed in the holder section 13*b*. The magnetic shunt element 16 is lowered by means of the coil spring 15 and stopped by means of a flange section 13*c* provided at a lower end of the holder section 13*b*. Consequently, the magnetic shunt element 16 is attached to the movable element 13 so as to be movable in the direction of expansion of the coil spring 15 (the direction of movement of the movable element 13). The magnetic shunt element 16 is made up of a magnetic material, such as iron. In this case, the magnetic shunt element 16 constitutes a size of a disk that can enter the recess 2 of the sealing case 1 along with the holder section 13*b* of the movable element 13.

Moreover, a spring seat recessed annular section 17 is formed in a lower surface of the brim section 13*a* of the movable element 13, and a coil spring 18 is sandwiched between the spring seat recessed annular section 17 and the upper surface of the sealing case 1 (the case main body section 1*a*). The coil spring 18 functions as urging means that generates urging force for lifting the movable element 13 at all times and causing the magnetic shunt element 16 to stay at the essentially-top portion of the recess 2 of the sealing case 1 (a position spaced upwardly from the upper ends of the yokes 3 and 4).

An upper portion of the movable element 13 protrudes upwardly from the cylindrical section 12*a* of the cover 12 and corresponds to a brake pedal of an unillustrated vehicle.

Operation of the stop lamp switch having the foregoing configuration will now be described.

The vehicle stop lamp switch is in a state shown in FIG. 1 before depression of the brake pedal of the vehicle. Specifically, as mentioned previously, the movable element 13 is lifted by the coil spring 18, whereupon the magnetic shunt element 16 is held at the position upwardly spaced apart from the upper ends of the yokes 3 and 4.

Consequently, as a result of magnetic force of the magnet 5 extending solely to the movable contact 6 through the yokes 3 and 4, the movable contact 6 is attracted by the magnet 5 through the yokes 3 and 4 and elastically deformed into an essentially-horizontal position, thereby bringing the contact point 9 into contact with the contact point 11 of the stationary contact 10. Accordingly, at this time, the movable contact 6 establishes electrical conduction between the connection terminals 7 and 8 by means of an electrical channel including the movable contact 6 and the stationary contact 10.

When the brake pedal of the vehicle is depressed in this state, the movable element 13 compresses the coil spring 18 correspondingly and moves as indicated by arrow A shown in FIG. 3 along with the magnetic shunt element 16. Therefore, the magnetic shunt element 16 contacts the upper ends of the yokes 3 and 4. Contacting of the magnetic shunt 16 with the upper ends of the yokes 3 and 4 is elastically performed while the coil spring 15 is being compressed.

When the magnetic shunt 16 contacts the upper ends of the yokes 3 and 4, the magnetic force of the magnet 5 reaches to the magnetic shunt element 16 as well as to the movable contact 6 through the yokes 3 and 4. Therefore, the magnetic force reaching the movable contact 6 is changed correspondingly (weakened in this case), and the attractive force exerted on the movable contact 6 changes (becomes weak in this case). Consequently, the restoration force of the movable contact 6 from the elastically-deformed state surpasses the attractive force of the magnet 5 acting on the movable contact 6, whereupon the movable contact 6 is restored. The contact point 9 is released from the contact point 11 of the stationary contact 10 as shown in FIG. 3, so that the electrical channel between the connection terminals 7 and 8 is interrupted. Thus, the vehicle stop lamp switch responds to depression of the brake pedal of the vehicle, whereupon the unillustrated vehicle stop lamp is illuminated.

When depression of the vehicle brake pedal is released, all of the elements return to their original positions. The movable contact 6 is attracted by the magnet 5, thereby bringing the contact point 9 into contact with the contact point 11 of the stationary contact 10. Thus, the vehicle stop lamp is extinguished.

As mentioned above, according to the stop lamp switch having the configuration, the magnetic attractive force of the magnet 5 reaching the movable contact 6 in the sealing case 1 through the yokes 3 and 4 changes as a result of movement of the magnetic shunt element 16 induced by movement of the movable element 13 located outside the sealing case 1, whereby the movable contact 6 can be moved with respect to the stationary contact 10 without entering the sealing case 1. Therefore, the movable contact 1 and the stationary contact 10 housed in the sealing case 6 can be brought into or out of contact with each other without involvement of intrusion of, into the sealing case 1, lubricating oil and inorganic or organic extraneous matters which are present around the stop lamp switch. Thus, there can be obviated the risk of an electrical conduction failure between the contacts 6 and 10, which would otherwise conventionally be induced by intrusive matters.

A change in the magnetic attractive force of the magnet 5 reaching the movable contact 6 in the sealing case 1 through the yokes 3 and 4, the change being induced by movement of the magnetic shunt element 16, can be made abrupt when compared with that achieved when the magnet 5 itself is moved. Therefore, the movable contact 6 and the stationary contact 10 can be brought into or out of contact with each other more rapidly, and switching performance can be enhanced.

FIGS. 4 through 7 show second and third embodiments (second and third modes of practice) of the present invention. The elements that are the same or similar to those described in connection with the first embodiment are assigned the same reference numerals, and their explanations are omitted here for brevity, and explanations are given solely to a difference.

Second Embodiment

Figure 4:
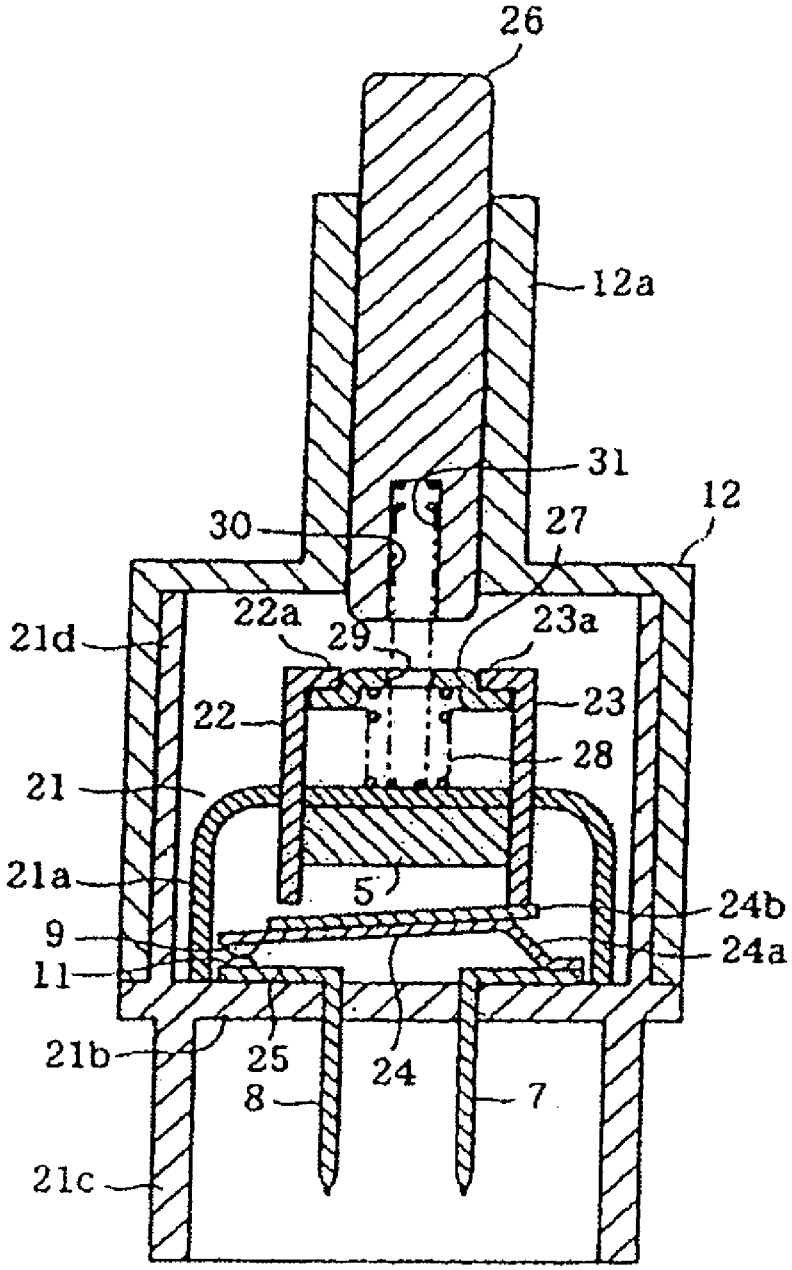
FIG. 4 is a view corresponding to FIG. 1, showing a second embodiment of the present invention.
Figure 5:
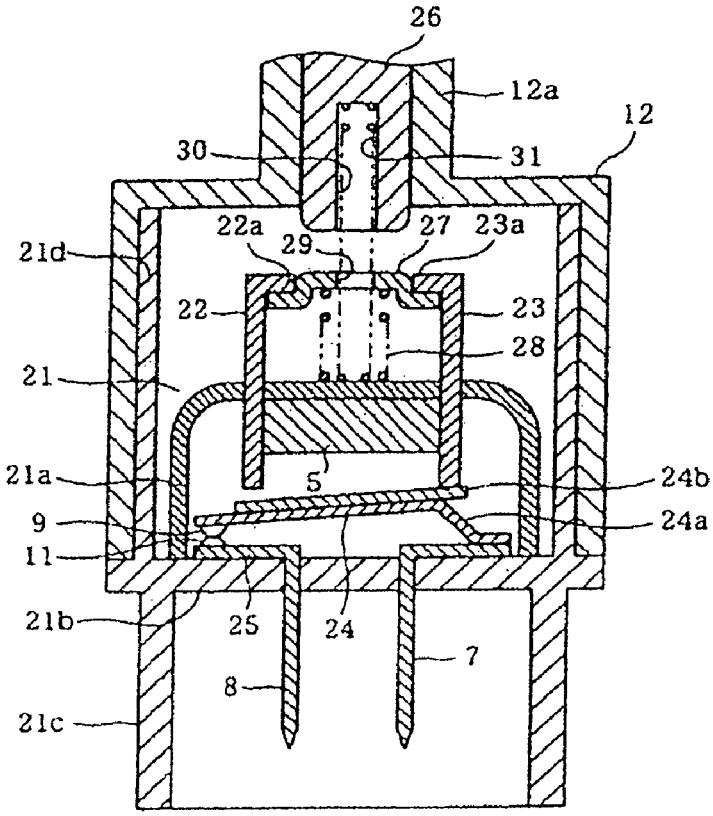
FIG. 5 is a longitudinal cross-sectional view of the principal section achieved before operation of the movable element.
Figure 6:
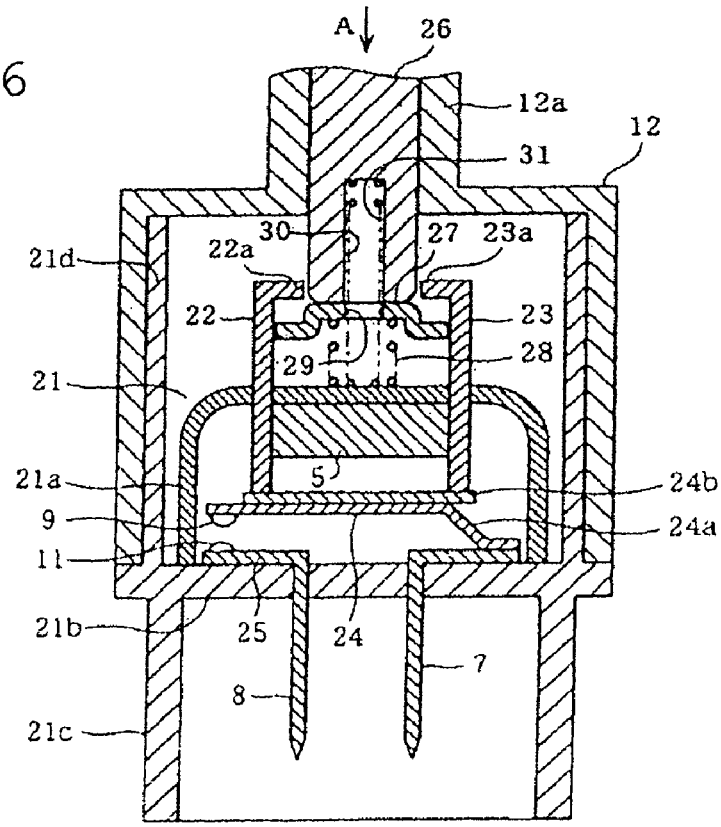
FIG. 6 is a longitudinal cross-sectional view of the principal section achieved after operation of the movable element.

In a second embodiment shown in FIGS. 4 through 6, a sealing case 21 is first made up of an essentially-dome-shaped case main body section 21*a* and a case bottom plate 21*b* in place of the sealing case 1 of the first embodiment.

As in the case with the yokes 3 and 4 in the case main body section 1*a* of the first embodiment, yokes 22 and 23 are provided in an upper portion of the case main body section 21*a* so as to protrude upward of the case main body section 1*a* much greater than the yokes 3 and 4. The yokes 22 and 23 take the place of the yokes 3 and 4 of the first embodiment; are made of a magnetic material, such as iron; and possess magnetism.

In the case main body section 21*a*, the magnet 5 is sandwiched between the yokes 22 and 23 in a contacting manner, and a movable contact 24 is disposed at a position immediately below the yokes 22 and 23. The movable contact 24 takes the place of the movable contact 6 of the first embodiment, and is made up of a contact main plate 24*a* formed from a conductive spring material, such as a nonmagnetic phosphor bronze, and a magnetic plate 24*b* made of a magnetic material, such as iron, adhering to an upper surface of the contact main plate 24*a*. The movable contact 24 is analogous to the movable contact 6 of the first embodiment in that the movable contact has magnetism stemming from the magnetic plate 24*b*. However, the contact point 9 is provided on the lower surface of the extremity of the contact main plate 24*a*.

The contact main plate 24*a* is joined to the connection terminal 7, and the connection terminal 7 is provided so as to be in contact with and penetrate through a case bottom plate 21*b* along with a connection terminal 8. Further, as in the case of the movable contact 6 of the first embodiment, the contact main plate 24*a* extends from a point where the contact main plate is bonded to the connection terminal 7 in an upwardly left oblique direction in FIGS. 4 and 5. Moreover, in normal conditions, the contact main plate extends in a downwardly left oblique direction in FIGS. 4 and 5.

The case bottom plate 21*b* is connected to a bottom of the case main body section 21*a*, thereby hermetically closes opening of the bottom section. In this state, as in the case of the movable contact 6 of the first embodiment, a right end of the magnetic plate 24*b* of the movable contact 24 is in contact with a lower end of a right yoke 23 at the top of the contact main plate 24*a* extending in an upwardly oblique direction from a point where the contact main plate is connected to the connection terminal 7. Further, a portion of the movable contact 24 extending in a downwardly left oblique direction in FIGS. 4 and 5 is situated so as to be separated downwardly from a left yoke 22.

The contact point 11 of a stationary contact 25 is disposed opposite and below the contact point 9 so as to come into contact with the contact point 9, and the stationary contact 25 is formed integrally with the connection terminal 8.

The case bottom plate 21*b* is joined to the bottom of the case main body section 21*a* as mentioned above. As a result, the case bottom plate constitutes the sealing case 21. The stationary contact 25 and lower portions of the movable contact 24, the magnet 5, and the yokes 22 and 23 are housed in the sealing case 21.

A cylindrical section 21*c* surrounding the connection terminals 7 and 8 is formed downward of the case bottom plate 21*b*, and a cylindrical section 21*d* surrounding the case main body section 21*a* is formed upward of the case bottom plate. A cover 12 is attached to an exterior of the upper cylindrical section 21*d*.

In place of the movable element 13 of the first embodiment, a rod-shaped movable element 26 not having a brim section or a holder section is inserted into a cylindrical section 12*a* of the cover 12. In contrast, a magnetic shunt 27 is interposed between stopper sections 22*a* and 23*a* which are formed in a bent manner in upper portions of the yokes 22 and 23. The magnetic shunt element 27 takes the place of the magnetic shunt element 16 of the first embodiment and is made of a magnetic material, such as iron. Both sides of the magnetic shunt element are situated below the stoppers 22*a* and 23*a*.

A coil spring 28 is interposed between the magnetic shunt element 27 and an upper surface of the sealing case 21 (the case main body section 21*a*). The coil spring 28 is arranged so as to serve as urging means that exhibits urging force for lifting the magnetic shunt element 27 in normal times so as to contact the stopper sections 22*a* and 23*a* and, by extension, with the yokes 22 and 23.

A hole 29 is formed in the center of the magnetic shunt element 27. A coil spring 31 is interposed, through the hole 29 of the magnetic shunt element 27, between an upper surface of the sealing case 21 (the case main body section 21*a*) and a deepest end of the hole 30 formed upwardly from the lower end of the movable element 26. The coil spring 31 serves as urging means for generating urging force for lifting the movable element 26 in normal conditions so as to separate from the magnetic shunt element 27.

As is the case with the movable element 13 of the first embodiment, the upper portion of the movable element 26 projects upwardly from the cylindrical section 12*a* of the cover 12, to thus comply with the brake pedal of the unillustrated vehicle.

Operation of the second embodiment will now be described.

Before operation for depressing the brake pedal of the vehicle is performed, the vehicle stop lamp switch is in a state shown in FIG. 4. Specifically, as mentioned previously, the magnetic shunt element 27 is lifted by the coil spring 28 and remains in contact with the yokes 22 and 23, and the movable element 26 is lifted by means of the coil spring 31, to thus separate from the magnetic shunt element 27.

Consequently, the magnetic force of the magnet 5 is shunted by the magnetic shunt element 27 through the yokes 22 and 23 and does not reach to the movable contact 24 (the magnetic plate 24*b*). Hence, the movable contact 24 still remains in an ordinary state, and a portion of the movable contact 24 extending in a downwardly left oblique direction in FIGS. 4 and 5 is separated downwardly from the left yoke 22, so that the contact point 9 is brought into contact with the contact point 11 of the stationary contact 25. Therefore, at this time, the movable contact 24 establishes electrical conduction between the connection terminals 7 and 8 by means of an electrical channel passing through the movable contact 24 and the stationary contact 25.

When a brake pedal of a vehicle is depressed in this state, the movable element 26 compresses the coil spring 31, to thus move as indicated by arrow A shown in FIG. 6. A lower end of the thus-moved movable element 26 presses the magnetic shunt element 27, whereupon the magnetic shunt element 27 is separated from the yokes 22 and 23. Movement of the magnetic shunt element 27 stemming from pressing action of the movable element 26 is elastically performed while the coil springs 28 and 31 are being compressed.

When the magnetic shunt element 27 is separated from the yokes 22 and 23 as mentioned above, magnetic force of the magnet 5 is released from a shunt state induced by the magnetic shunt element 27 through the yokes 22 and 23, to thus reach the movable contact 6 (the magnetic plate 24*b*). Consequently, the movable contact 6 is attracted by the magnet 5 through the yokes 3 and 4, to thus become essentially-horizontally, elastically deformed, whereupon the contact point 9 is separated from the contact point 11 of the stationary contact 10. Therefore, the electrical channel between the connection terminals 7 and 8 is interrupted, so that the vehicle stop lamp switch responds to depression of the brake pedal of the vehicle, to thus illuminate the unillustrated vehicle stop lamp.

All of the elements return to their original states, so long as the depression of the vehicle brake pedal is released, whereupon the movable contact 24 is released from attraction effected by the magnet 5, thereby bringing the contact point 9 into contact with the contact point 11 of the stationary contact 25. Thus, the vehicle stop lamp is extinguished.

Specifically, operation for bringing the magnetic shunt element 27 into and out of contact with the yokes 22 and 23 performed before and during depression of the brake pedal of the vehicle in the first embodiment is reversed in the second embodiment. In other respects, contacting and separation operations are the same as those performed in the first embodiment. Consequently, an effect of preventing intrusion of extraneous matters and an effect of enhancing switching performance, which are the same as those yielded in the first embodiment, can be yielded.

Third Embodiment

Figure 7:
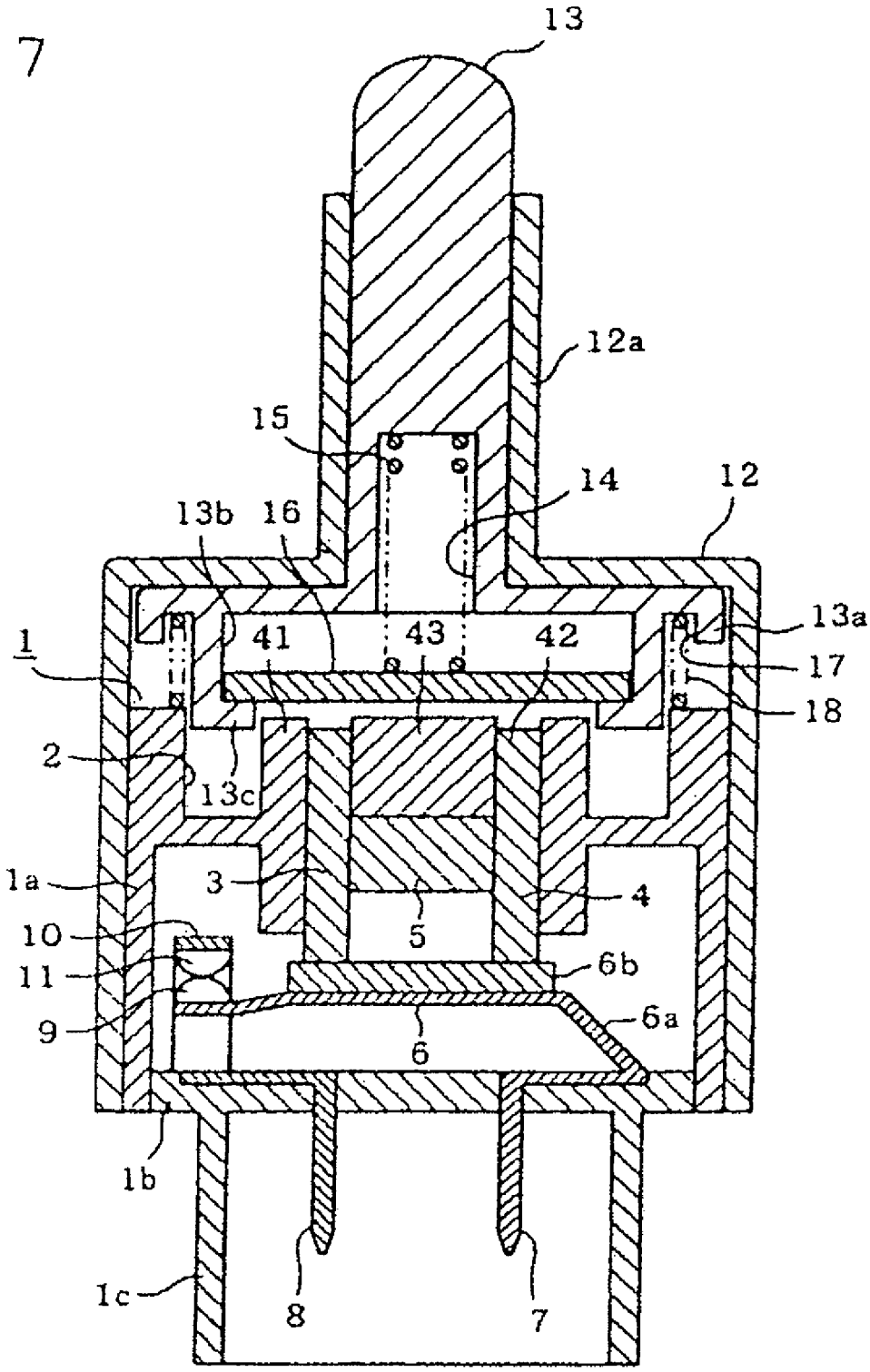
FIG. 7 is a view corresponding to FIG. 1, showing a third embodiment of the present invention.

In a third embodiment shown in FIG. 7, sections 41 and 42 adjoining exteriors of the respective yokes 3 and 4 of the case main body section 1*a* of the first embodiment are formed so as to extend vertically, thereby making a section 43 adjoining interiors of the respective yokes 3 and 4 extend upwardly.

As opposed to the yokes 3, 4 and the magnetic shunt element 16 that are made of metal, the case main body section 1*a* is formed from resin molded by inserting the yokes 3 and 4; in particular, a synthetic resin. Since the case main body section 1*a* is held in close contact with the yokes 3 and 4, the extending sections 41 to 43 of the case main body section 1*a* are integrated, as members made of a resin, closely with the yokes 3 and 4. Moreover, the resin is a sound proofing material. Consequently, the extending sections 41 to 43 are integrated, as a soundproofing material made of a resin, closely with the yokes 3 and 4.

Further, upwardly-stretching portions of the extending areas 41 to 43 slightly protrude from the yokes 3 and 4 in the vertical direction that faces the magnetic shunt element 16. Therefore the soundproofing material protrudes toward the magnetic shunt element 16 than do the yokes 3 and 4.

In the vehicle stop lamp switch configured as mentioned above, vibrations of the yokes 3 and 4 that are induced when the magnetic shunt element 16 attempts to contact the yokes 3 and 4 attempt are dampened by the extending sections 41 to 43 (a soundproofing member), whereby a sound, which will be generated, can be made dull and small.

In particular, the upwardly-stretching portions of the respective extending sections 41 to 43 protrude toward the magnetic shunt element 16 than do the yokes 3 and 4, whereby, when attempting to contact the yokes 3 and 4, the shunt element 16 contacts the portions of the respective extending sections 41 to 43 protruding toward the magnetic shunt element 16 than do the yokes 3 and 4. As a result, collision of the magnetic shunt element 16 with the yokes 3 and 4 is avoided, so that a sound, which will be generated when the magnetic shunt element 16 contacts the yokes 3 and 4, can be lessened.

In addition, the present invention is not limited solely to the above-mentioned embodiment shown in the drawings. In connection particularly with the stationary contact and the movable contact, a change may also be made in such a way that the movable contact departs from the stationary contact before depression of the brake pedal of the vehicle and that the movable contact contacts the stationary contact in response to depression of the brake pedal of the vehicle.

Moreover, the movable contact may also be formed from a one-component material; that is, a magnetic material exhibiting conductivity, rather than from a two-component material including a contact main plate made of a conductive material (a nonmagnetic material) and a magnetic plate made of a magnetic material. In particular, when the movable contact is made of such a one-component material, there is yielded an advantage of a reduction in the number of components to be used.

Further, the present invention can be generally applied to a switching device, other than the vehicle stop lamp switch, which suffers the problems analogous to those mentioned previously. In addition, the present invention can be practiced after being altered, as required, within the scope of the gist of the invention.

What is claimed is:

1. A switching device comprising:

a stationary contact;

a movable contact that is in correspondence with the stationary contact and exhibits magnetism;

a sealing case that houses and seals the stationary contact and the movable contact;

a yoke that is in correspondence with the movable contact and exhibits magnetism;

a magnet that exerts magnetic force to the yoke to attract the movable contact through the yoke;

a movable element that is disposed outside the sealing case and is movably operated; and a magnetic shunt element that is moved by the movable element, wherein the magnetic shunt element is moved so as to change a distance to the yoke and change attractive force exerted on the movable contact by the magnet through the yoke, thereby moving the movable contact with respect to the stationary contact.

2. The switching device according to claim 1, wherein the movable contact is formed from a magnetic one-component material exhibiting electrical conductivity.

3. The switching device according to claim 1, wherein the yoke and the magnetic shunt element are made of metal, and a soundproofing member made of a resin is integrated closely with the yoke.

4. The switching device according to claim 3, wherein the soundproofing member projects toward the magnetic shunt element as compared with the yoke.

5. The switching device according to claim 1, wherein the movable element and the magnetic shunt element are configured to linearly move toward the yoke.

6. A switching device comprising:

a stationary contact;

a movable contact that is in correspondence with the stationary contact and exhibits magnetism;

a sealing case that houses and seals the stationary contact and the movable contact;

a plurality of yokes, fixed to the sealing case, that are in correspondence with the movable contact and exhibit magnetism;

a magnet, disposed between the yokes, that exerts magnetic force to the yokes to attract the movable contact through the yokes;

a movable element that is disposed outside the sealing case and is movably operated; and a magnetic shunt element that is moved by the movable element, wherein the magnetic shunt element is moved so as to change a distance to the yokes and change attractive force exerted on the movable contact by the magnet through the yokes, thereby moving the movable contact with respect to the stationary contact.

* * * * *